US005204653A

United States Patent [19]

Saitoh et al.

[11] Patent Number: 5,204,653

[45] Date of Patent: Apr. 20, 1993

[54] ELECTROMAGNETIC INDUCTION DEVICE WITH MAGNETIC PARTICLES BETWEEN CORE SEGMENTS

[75] Inventors: Susumu Saitoh; Tetsurou Itoh; Naoki Kuroda, all of Osaka, Japan

[73] Assignee: Tabuchi Electric Co., Ltd., Osaka, Japan

[21] Appl. No.: 643,949

[22] Filed: Jan. 22, 1991

[30] Foreign Application Priority Data

Jan. 22, 1990 [JP] Japan ..... 2-13355
Apr. 20, 1990 [JP] Japan ..... 2-105692
Sep. 25, 1990 [JP] Japan ..... 2-256616

[51] Int. Cl.[5] ..... H01F 17/06; H01F 27/26

[52] U.S. Cl. ..... 336/178; 336/210; 336/212; 336/218

[58] Field of Search ..... 336/83, 178, 210, 212, 336/165, 218, 219, 233; 335/281, 297

[56] References Cited

U.S. PATENT DOCUMENTS 2,976,502 3/1961 Hill ..... 336/83
3,028,570 4/1962 Taylor ..... 336/83
3,195,086 7/1965 Taylor ..... 336/83

FOREIGN PATENT DOCUMENTS 2124478 11/1972 Fed. Rep. of Germany ..... 336/178
649498 12/1928 France ..... 336/178
1-284574 11/1989 Japan ..... 336/178

*Primary Examiner*—Thomas J. Kozma

[57] ABSTRACT

An electromagnetic induction device which comprises a split-type core assembly comprising at least one winding formed thereon and first and second core segments each having at least two joint faces spaced apart from each other, the first and second core segments are connected together with the joint faces of one of the first and second core segments held in contact with the joint faces of the other of the first and second core segments, and a finely divided ferromagnetic material is interposed between the joint faces of the respective first and second core segments. The ferromagnetic material used has an average particle size sufficient to form a magnetic fluid medium.

25 Claims, 8 Drawing Sheets

ELECTROMAGNETIC INDUCTION DEVICE WITH MAGNETIC PARTICLES BETWEEN CORE SEGMENTS

BACKGROUND OF THE INVENTION

1. Field of the Invention

The present invention generally relates to an electromagnetic induction device such as, for example, a transformer or a choke of a type employing a split-type core assembly.

2. Description of the Prior Art

As a choke and a transformer, there has long been employed a split-type core assembly comprising a plurality of split core segments made of soft magnetizable material. An example of the prior art split-type core assemblies is shown in FIG. 13 of the accompanying drawings for the purpose of discussion of the prior art believed to be pertinent to the present invention.

Referring to FIG. 13, the prior art split-type core assembly 50 for a choke, schematically shown therein in perspective view, comprises a core body split into a pair of core segments 15 of substantially identical shape. Those split core segments 51 have respective windings 52 turned therearound in balanced fashion so that, when electric currents are supplied to the windings 52 on the corresponding split core segments 51 from a suitable source of electric current, the magnetic fields can be developed in respective directions opposite to each other. Although not shown, those split core segment 51 are urged by compression springs in directions opposite to each other shown by the arrow P to contact with each other thereby to complete the split-type core assembly 50.

This prior art split-type core assembly 50 is assembled by preparing the windings 52 wound on respective bobbins, subsequently mounting the bobbins, having the windings 52 wound therearound, on the associated split core segments 51, and finally mating the split core segments 51 together by the application of urging forces to the split core segments 51 in the direction opposite to each other. Therefore, as compared with the choke employing a solid core body to form a closed magnetic path, this type of split-type choke is advantageous in that the split core assembly is inexpensive and can be manufactured easily.

However, this type of split-type core assembly 50 has a problem which will now be discussed. Each of the split core segments 51 so far shown is shaped to represent a generally E-shaped configuration having three arms. When the split core segments 51 are mated together by the application of the urging forces generated by the respective compression springs applied thereto from the directions opposite to each other, split end faces 54 of the arms of those split core segments 51 are brought into contact with each other. As best shown in FIG. 14 showing on an exaggerated scale, one of joints between the respective arms of the split core segments 51, the presence of minute indentations H and/or cracks C at each split end face 54 results in inclusion of air gaps A at the joints between the respective arms of the split core segments 51. Therefore, once the air gaps A are included at the joints between the respective arms of the split core segments 51, the magnetic permeability of the split-type core assembly 50 as a whole tends to be lowered.

By way of example, if the non-split core body exhibits a magnetic permeability of about 10,000, the magnetic permeability will be reduced 50% down to about 5,000 when the core assembly is assembled by the use of the split core segments.

Accordingly, as compared with the non-split core assembly, the split-type core assembly requires the number of turns of each windings 52 which is about 1.4 times that of the winding in the non-split core assembly so that the split-type core assembly can provide an inductance equal to that exhibited by the non-split core assembly. Thus, the increase in number of turns of each windings 52 results in an increase in electric resistance and also in distributed capacitance and, consequently, the characteristic of the choke tends to be lowered.

On the other hand, the magnetic permeability can be increased to 80% of that exhibited by the non-split core assembly if each split end face 54 is surface-finished to a surface smoothness in the order of submicron (specifically not greater than 1.0μm). However, the surface treatment to provide the precisely polished surface on each split end face 54 tends to result in an increase of the manufacturing cost and the resultant core assembly will be expensive.

It can be contemplated that the split core segments 51 are bonded together by the use of a bonding material thereby to complete the split-type core assembly in view of the fact that the bonding material containing ferromagnetic particles of 10μm or greater in particle size has been made available such as disclosed in the Japanese Laid-open Patent publication No. 1-284574. It has, however, been found that, since the particle size of the ferromagnetic particles contained in the bonding material is relatively great, the use of such bonding material in an attempt to connect the split core segments together results in that the air gaps A tend to expand as a result of an inclusion of the relatively large particles in the bonding material, and therefore, unless the bonding material employs particles of high magnetic permeability, the magnetic permeability of the split-core assembly as a whole tends to be lowered.

The foregoing problems discussed above can be equally found in a transformer or choke employing a yoke-mounted core, i.e., employing a core having a yoke (hereinafter referred to as a yoke-mounted core) such as shown in FIG. 15. Referring to FIG. 15, a yoke 63 is secured to the core 62 which is in the form of an open-ended bar (a type wherein no closed magnetic circuit is formed) having primary and secondary windings 60 and 61 formed therearound. The mounting of the primary and secondary windings 60 and 61 on the core 62 can easily be accomplished since the primary and secondary windings 60 and 61 are turned around respective bobbins (not shown) and the core 62 is subsequently inserted through the bobbins prior to the mounting of the yoke 63 to the core 62. However, the presence of minute surface indentations and/or cracks can be found at surface areas 64 and 65 of contact between the yoke 63 and the core 62 and, therefore, by the same reasoning as discussed above, the magnetic permeability of the core assembly as a whole tends to be lowered due to the presence of air gaps.

SUMMARY OF THE INVENTION

The present invention has therefore been devised to substantially eliminate the above discussed problems and is intended to provide an improved electromagnetic induction device comprising either a split-type core assembly or a yoke-mounted core assembly, which can exhibit an improved characteristic and which can be assembled without substantially incurring an increase in manufacturing cost.

According to the present invention, surface indentations and/or cracks appearing in each of joint faces of the split core segments which are to be brought into contact with each other to complete the split-type core assembly are filled up by finely divided ferromagnetic particles of an average particle size required to form the magnetic fluid medium. The average particle size of the finely divided ferromagnetic particles is so small that air gaps will not be enlarged. The size is generally not greater than 1μm, and preferably within the range of about 20 to about 300 angstrom (Å).

It often occurs that, when an external impact acts on the split-type core assembly, the split core segments connected together may displace in position relative to each other, accompanied by a deformation in shape of each gap delimited between the joint faces of the respective core segments. Once this happens, the magnetic permeability of the split-type core assembly as a whole will be reduced. However, according to one preferred embodiment of the present invention, any possible reduction in magnetic permeability of the split-type core assembly resulting from the application of the external impact can be advantageously avoided since the split core segments are firmly mechanically connected together.

Also, according to another preferred embodiment of the present invention, a sealing member is used to encompass an outer perimeter around each joint between the split core segments and, therefore, a dispersing agent (solvent) used in the preparation of the magnetic fluid medium interposed between the joint faces of the split core segments does not evaporate. Because of this, even when the external impact is applied to the split-type core assembly to such an extent as to result in a displacement in position between the core segments, accompanied by a deformation in shape of the gaps, the finely divided ferromagnetic particles suspended in the dispersing agent can sufficiently penetrate into the gaps.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined solely by the appended claims. In the accompanying drawings, like reference numerals are used to denote like parts throughout the several views, and:

DETAILED DESCRIPTION OF THE EMBODIMENTS

Figure 1:
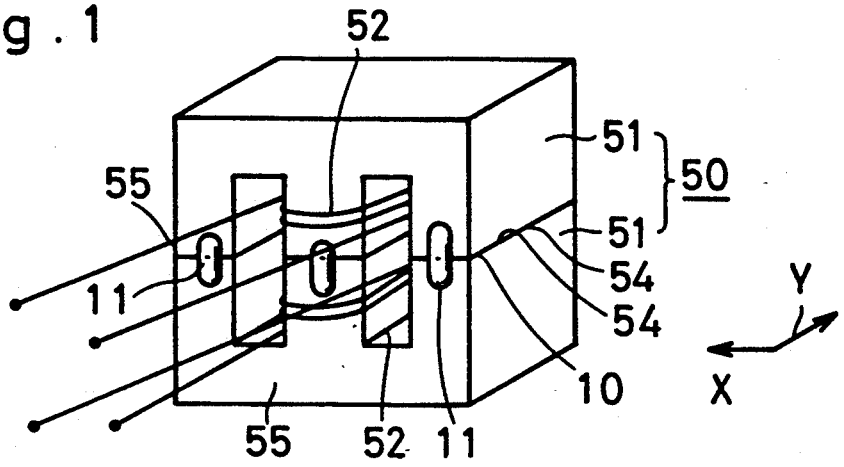
FIG. 1 is a schematic perspective view of a choke according to a first preferred embodiment of the present invention.
Figure 2:
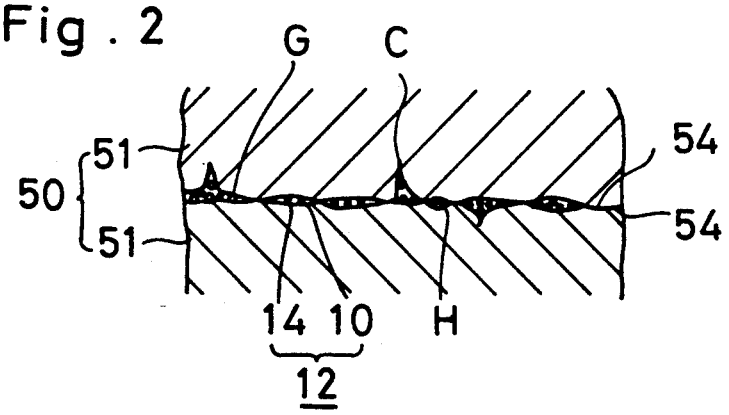
FIG. 2 is an exaggerated view of a portion of the choke shown in FIG. 1, showing the joint between split core segments.

FIGS. 1 to 3 illustrates a split-type core assembly according to the first preferred embodiment of the present invention.

Referring now to FIGS. 1 to 3, the split-type core assembly 50 shown therein comprises a pair of split core segments 51 of generally E-shaped configuration each having three arms. Each arm of each of the E-shaped split core segments 51 has a free end face 54 adapted to be held in tight contact with the corresponding free end face 54 of the other of the split core segments 51 when the split core segments 51 are mated together to complete the split-type core assembly 50. Each free end face 54 in each of the split core segments 51 is ground with the use of an abrasive material of 30 μm in particle size.

As best shown in FIG. 2, ferromagnetic particles 10 of an average particle size sufficient to form a magnetic fluid are filled in gaps G each defined between the free end faces 54 of the respective split core segments 51 when the latter are mated together.

The split core segments 51 shown in FIG. 1 are connected together by means of several deposits 11 of bonding agent made of, for example, epoxy resin or silicone resin applied to preselected locations of respective peripheral fringe 55 at respective end faces 54 of the split core segments 51.

Figure 13:
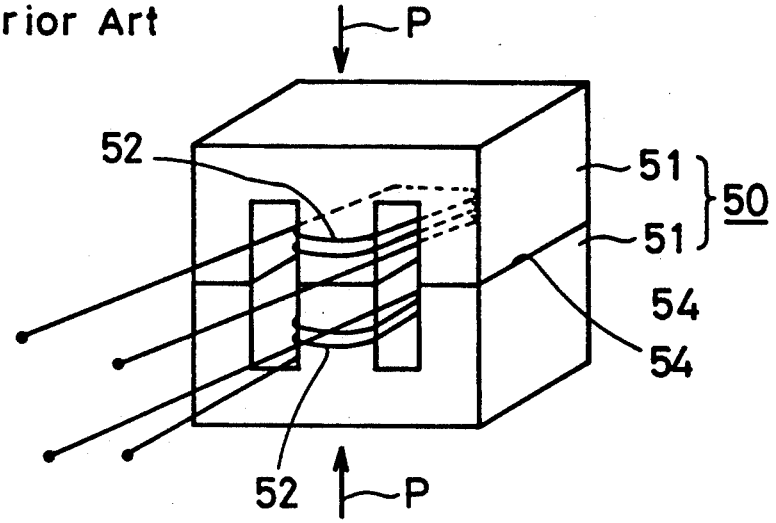
Fig. 13 Prior Art
FIG. 13 is a schematic perspective view of the prior art choke.
Figure 14:
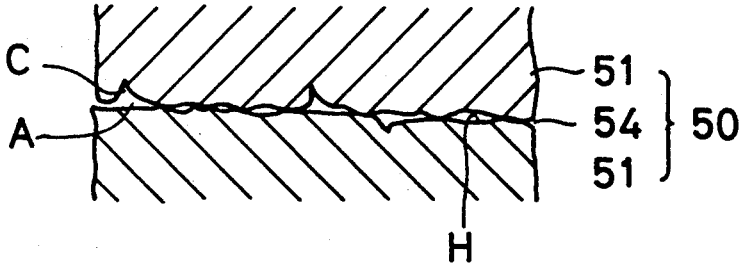
Fig. 14 Prior Art
FIG. 14 is an exaggerated view of a portion of the prior art choke shown in FIG. 13, showing the joint between split core segments.
Figure 15:
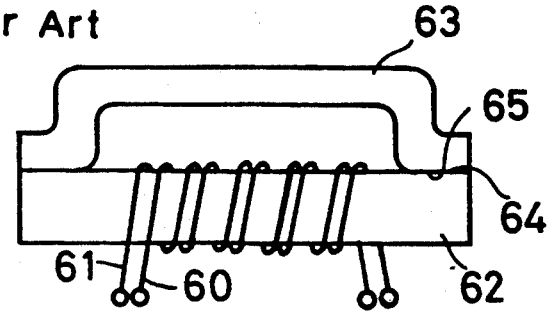
Fig. 15 Prior Art
FIG. 15 is a schematic elevational view of the prior art transformer employing the yoke-mounted core assembly.

The windings 52 are mounted on the split-type core assembly of FIG. 1 in a manner similar to those shown in and described with reference to FIG. 13. In other words, the other structure of the split-type core assembly 50 according to the foregoing embodiment of the present invention than those described above is substantially identical with that in the prior art split-type core assembly shown in FIG. 13.

The choke of the structure shown in and described with reference to FIGS. 1 and 2 is assembled in the following manner.

After the free end faces 54 of the respective arms of each of the split core segments 51 have been ground with the use of the abrasive material of 30 μm in particle size, the windings 52 turned around respective bobbins (not shown) are mounted around the split core segments 51. Then, a magnetic fluid medium 12 prepared by the use of a coprecipitation method is painted to the respective free end faces 54 of the arms of the split core segments 51 as shown in FIG. 2. After the application of the magnetic fluid medium 12, the split core segments 51 are mated together with the free end faces 54 of one core segment 51 held in light contact with the mating free end faces 54 of the other core segment 51, followed by the application of the bonding agent to the end faces 54 of the split core segments 51 to form the bond deposits 11, thereby completing the choke. After the application of the bonding agent to firmly connect the split core segments 51 together as shown in FIG. 1, ferromagnetic particles 10 contained in the magnetic fluid medium 12 remain within the gaps G having adhered to the free end faces 54 of the arms of the respective core segments 51, even though a dispersing agent 14 also contained in the magnetic fluid medium 12 evaporates with passage of time.

The magnetic fluid medium 12 referred to above and used in the practice of the present invention means a fluid medium capable of exhibiting a magnetic behavior which is prepared by stably dispersing a high concentration of finely divided ferromagnetic particles 10 into the dispersing agent 14 with the use of a surface active agent used to stabilize the ferromagnetic particles 10 in the dispersing agent 14. As the magnetic fluid medium 12 utilizable in the practice of the present invention, an oxide-based magnetic fluid medium (for example, ferrite fluid medium of manganese-zinc system) containing finely divided ferromagnetic particles 10 in a quantity of 10 to 25 volume percent, a metal-based magnetic fluid medium containing nickel or cobalt, or a nitrided iron-based magnetic fluid medium may be employed. Preferably, the finely divided ferromagnetic material 10 contained in the magnetic fluid medium 12 is of a type having an average particle size generally not greater than 1 μm and, for example, within the range of about 20 to about 300 angstrom.

The dispersing agent 14 contained in the magnetic fluid medium 12 may be a petrochemical substance such as, for example, kerosine or paraffin, or water.

In the structure shown in FIGS. 1 and 2, the finely divided ferromagnetic particles 10 contained in the magnetic fluid medium 12 penetrate into the surface indentations H and/or cracks C present on each of the free end faces 54 defining the gaps G, thereby to fill up those gaps G between the arms of the respective core segments 51. Therefore, the magnetic permeability at the gaps G can be considerably improved. In addition, since the ferromagnetic particles 10 are finely divided, none of the gaps G will be enlarged and, accordingly, in the case where the non-split core assembly exhibits a specific magnetic permeability of about 10,000, the magnetic permeability of the split-type core assembly 50 as a whole embodying the present invention can be increased to 80 to 85% of that of the non-split core assembly. It has been found that the increase of the magnetic permeability to 80 to 85% of that of the non-split core assembly could be obtained regardless of the evaporation of the dispersing agent 14 (See FIG. 2) contained in the magnetic fluid medium 12.

Since the increase in magnetic permeability can be obtained in the split-type core assembly 50 according to the present invention as discussed above, the number of turns of each winding 52 can be reduced as compared with that in the prior art split-type choke and, therefore, a reduction in electric resistance as well as in stray capacitance can be achieved accompanied by an improvement of the characteristic of the choke.

Also, according to the present invention, the free end faces 54 of the arms of each of the split core segments 51 need not be precisely ground to the order of submicron and, therefore, there is no possibility that the manufacturing cost may be considerably increased.

It is to be noted that, although in the foregoing embodiment of the present invention, the split core segments 51 have been described as connected together by means of the bond deposits 11, the use of the bonding agent to form the bond deposits 11 may not be always essential in the practice of the present invention. Where no bonding agent is used to connect the split core segments 51 together thereby to complete the split-type core assembly 50, the magnetic permeability of the split-type core assembly 50 as a whole may be reduced a certain extent when, after the evaporation of the dispersing agent 14 contained in the magnetic fluid medium 12 as shown in FIG. 2, an impact is applied to the split-type core assembly 50. This is because, when the impact is applied to the split-type core assembly 50, the split core segments 51 may be somewhat displaced in position relative to each other in a direction shown by the arrow X or in a direction shown by the arrow Y, accompanied by a deformation in configuration of each gap G shown in FIG. 2 to such an extent as to result in the reduction in magnetic permeability.

Therefore, the firm connection between the split core segments 51 by the use of the bonding agent to form the bond deposits 11 such as effected in the foregoing embodiment of the present invention is desirable in that no relative displacement in position of the split core segments 51 occur even when the impact acts on the split-type core assembly 50 and, hence, any possible reduction in magnetic permeability of the split-type core assembly 50 can be avoided. Accordingly, where the choke is used under the environment where it tends to receive impacts, it is recommended to use the high frequency choke wherein the split core segments 51 are firmly connected together by the use of the bond deposits 11.

As a method of filling the magnetic fluid medium 12 in the gaps G, a method utilizing a capillarity as will subsequently be described may be employed other than the painting of the magnetic fluid medium 12 as hereinbefore described. The filling method utilizing the capillarity will now be described with particular reference to FIGS. 3(A) to 3(F).

When an injection container S such as, for example, a spout, having an injection nozzle S1, which has been filled with the magnetic fluid medium 12, is fitted to a side face of the split-type core assembly 50 with the injection nozzle S1 directed exteriorly to each gap G between the free end faces 54, the magnetic fluid medium 12 within the injection container S penetrates into the gap G by the effect of capillarity. Subsequent application of a direct current across the windings 52 causes the magnetic fluid medium 12, having penetrated into the gap G, to further penetrate into the surface indentations H and/or cracks C under the influence of an magnetic force developed by the supply of the direct current across the windings 52.

It is to be noted that the application of the direct current across the windings 52 described as employed in the practice of the method utilizing the capillarity can also be advantageously employed during the practice of the method based on the painting of the magnetic fluid medium 12 as hereinbefore described.

Figure 3A:
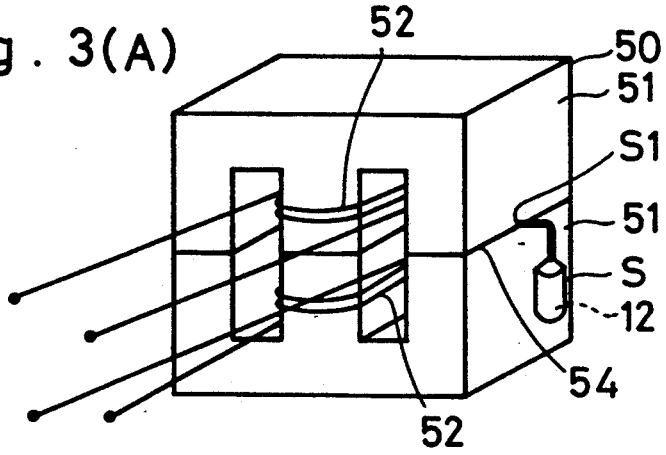
FIGS. 3(A) to 3(F) are diagrams showing the sequence of manufacture of the choke shown in FIG. 1.
Figure 3B:
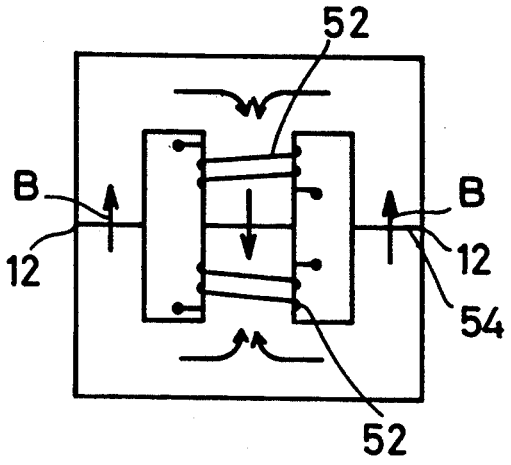
Figure 3C:
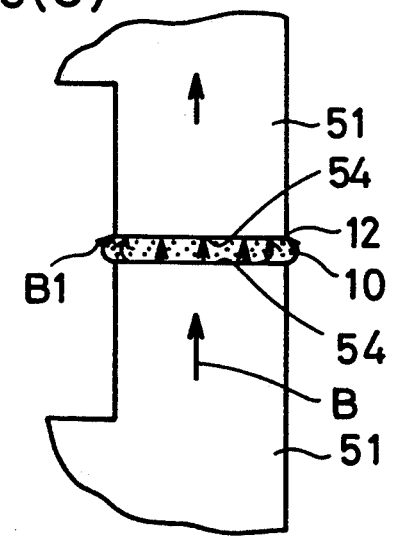

After the application of the magnetic fluid medium 12 by either the painting method or the capillary method, the split core segments 51 are brought together with the free end faces 54 in one core segment 51 held in contact with those in the other core segment 51, and as shown in FIG. 3(B), the direct current is subsequently supplied across the windings 52 to produce a magnetic field B acting in a direction perpendicular to the interface between the split core segments 51 which is generally flush with the free end faces 54 that are held in contact with each other. Once this magnetic field has been developed, the magnetic fluid medium can, under the influence of the magnetic force, penetrate deep into the surface indentations H and/or cracks C present in the free end faces 54 of the arms of the respective split core segments 51 defining the associated gaps G and, at the same time, as shown in FIG. 3(C), the magnetic fluid medium 12 expands outwards in a direction conforming to the lines B1 of magnetic force. While in this condition, the magnetic fluid medium 12 is allowed to dry thereby to connect the split core segments 51 together.

Figure 3D:
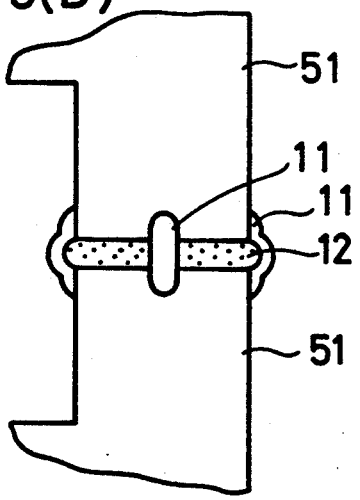

Thereafter, if so required, the bonding agent is applied to form the bond deposits 11, as shown in FIG. 3(D), to firmly connect the split core segments 51, thereby completing the choke.

Where the magnetic fluid medium 12 is allowed to harden by the application of the magnetic field B, the finely divided ferromagnetic particles 10 can line up in a direction conforming to the magnetic path and, therefore, the magnetic permeability of the split-type core assembly 50 as a whole can be improved. Also, since the magnetic fluid medium 12 when hardened flows outwardly to bulge as shown in FIG. 3(C), the magnetic path in the magnetic fluid medium 12 expands and, consequently, the magnetic permeability of the split-type core assembly 50 as a whole can further be improved.

Figure 3E:
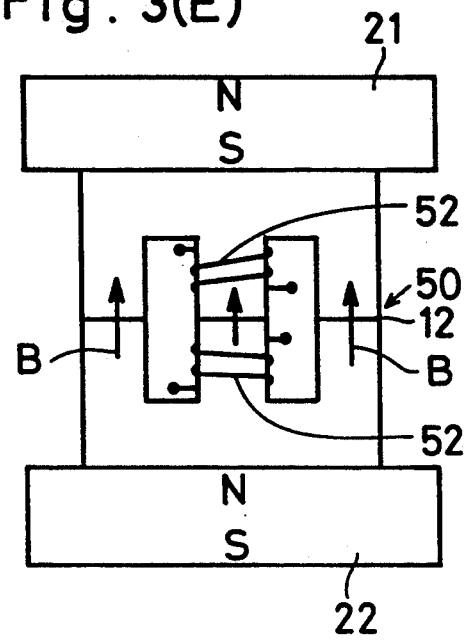
Figure 3F:
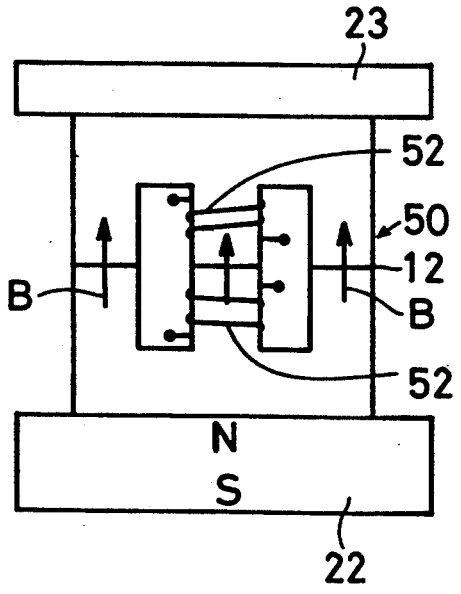

As an alternative method of applying the magnetic field B to the magnetic fluid medium 12, magnets 21 and 22 may be disposed on respective sides of the split-type core assembly 50 as shown in FIG. 3(E), or a magnet 22 and a magnetic path forming member 23 made of a soft magnetizable member such as, for example, iron may be disposed on respective sides of the split-type core assembly 50 as shown in FIG. 3(F).

Figure 4:
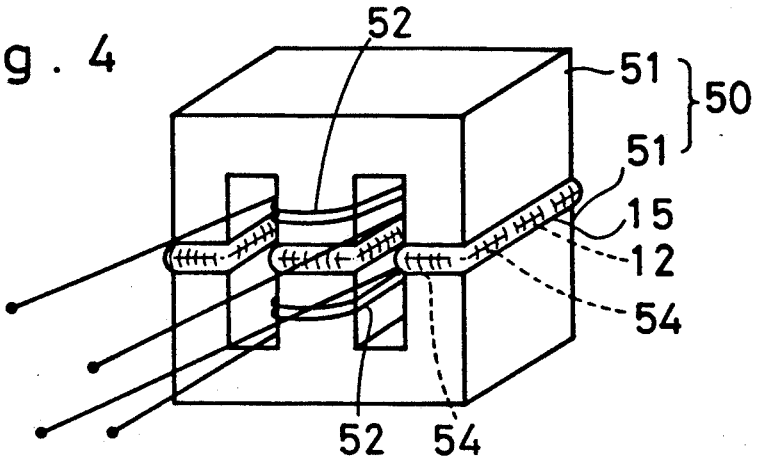
FIG. 4 is a schematic perspective view of the choke according to a second preferred embodiment of the present invention.

FIG. 4 illustrates the choke according to a second preferred embodiments of the present invention.

Referring to FIG. 4, the magnetic fluid medium 12 is interposed between the free end faces 54 of the arms of one core segment 51 and those of the other core segment 51, that is, filled in the respective gaps G. A peripheral open region of each of the gaps G delimited between the associated free end faces 54 of the split core segments 51 is closed by a sealing material 15 made of, for example, epoxy resin or silicone resin. The sealing material 15 is effective to avoid a complete evaporation of the dispersing agent 14 contained in the magnetic fluid medium 12.

According to the second preferred embodiment of the present invention, the magnetic fluid medium 12 is sealed within each of the gaps G. Therefore, even when the configuration of each of the gaps G varies as a result of a relative displacement in position of the split core segments 51 which occurs when the impact is applied to the split-type core assembly 50, the finely divided ferromagnetic particles 10 can effectively penetrate into the gaps G then varies in configuration, thereby to avoid any possible lowering of the magnetic permeability of the split-type core assembly 50 as a whole even when the impact acts thereon.

Figure 5:
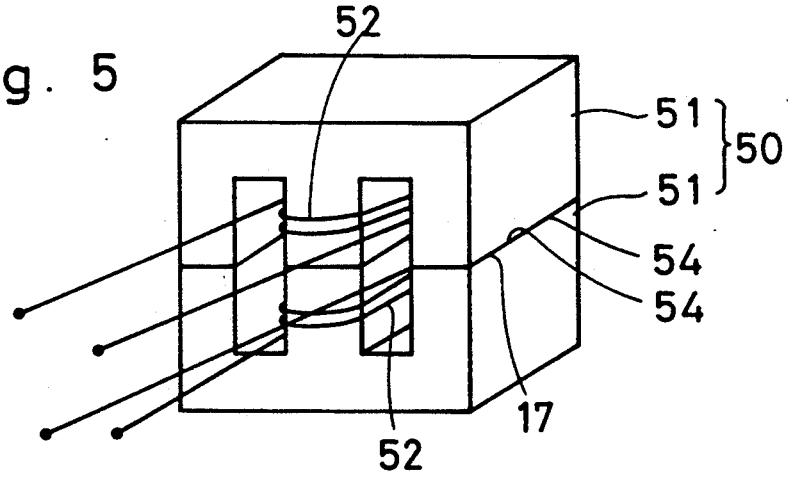
FIG. 5 is a schematic perspective view of the choke according to a third preferred embodiment of the present invention.
Figure 6:
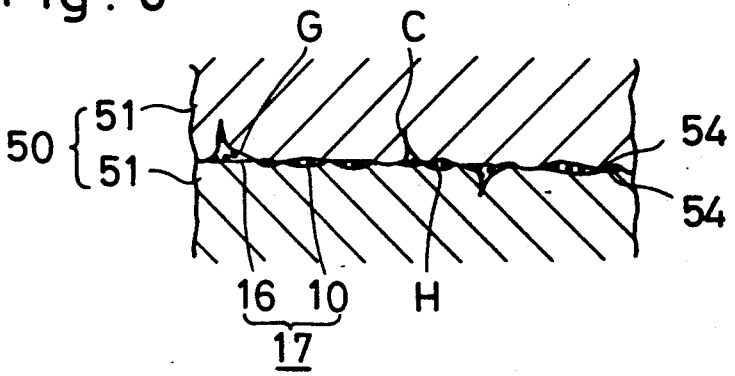
FIG. 6 is an exaggerated view of a portion of the choke shown in FIG. 5, showing the joint between the split core segments.

FIGS. 5 and 6 illustrates the choke according to a third preferred embodiment of the present invention. According to this preferred embodiment of the present invention shown therein, an adhesive filler material 17 made of resin 16 mixed with finely divided ferromagnetic particles 10 is filled and hardened in each of the gaps G between the free end faces 54 of the arms of one core segment 51 and those of the other core segment 51, as best shown in FIG. 6. Accordingly, the split core segments 51 are firmly connected together by means of the hardened resin 16.

For filling the adhesive filler material 17 in each of the gaps G, the following method may be employed. The magnetic fluid medium (i.e., the adhesive filler material 17) containing a monomer of thermosetting resin 16, used as the dispersing agent, in which finely divided ferromagnetic particles 10 are suspended is injected into each of the gaps G between the arms of one core segment 51 and those of the other core segment 51. Thereafter, the assembly is heated to effect a polymerization to cure the resin 16.

In the third preferred embodiment of the present invention, since each of the gaps G is filled with the adhesive filler material 17 of a type containing the resin 16 mixed with the finely divided ferromagnetic particles 10 so that the arms of one core segment 51 can be firmly connected with those of the other core segment 51, the split core segments 51 can be mechanically firmly interlocked with each other by the cured resin 16. Therefore, no relative displacement in position of the split core segments 51 will occur even when the impact acts on the resultant split-type core assembly 50. Also, the finely divided ferromagnetic particles 10 having penetrated into the surface indentations H and/or cracks C present on each free end faces 54 during the injection or painting of the magnetic fluid medium can be retained there in the form as injected or painted when the resin 16 is cured or hardened.

Thus, according to the third preferred embodiment of the present invention, not only can any possible relative displacement in position between the split core segments 51 be avoided, but also the finely divided ferromagnetic particles 10 can be retained in the form as injected or painted, and therefore, the magnetic permeability of the resultant split-type core assembly 50 will not be lowered with passage of time.

In the practice of any one of the foregoing preferred embodiments of the present invention, as the finely divided ferromagnetic particles 10, a powdered ferrite of manganese-zinc system, a powder of nitrided iron (iron nitride), a powdered ferrite containing manganese, iron, nickel, copper and/or magnesium, or a powdered mixture of iron and cobalt can be employed Where the ferrite or iron nitride having a magnetic permeability higher than that of a ferromagnetic material forming each of the split core segments 51 is employed, the split-type core assembly 50 as a whole according to the present invention can advantageously exhibit a magnetic permeability comparable to that exhibited by the non-split core assembly.

Particularly, the use of the magnetic fluid medium prepared by the use of particles of iron nitride is effective, and data have shown that the magnetic saturation does not occur before the magnetic flux density attains 2,000 gausses, as compared with the magnetic fluid medium prepared by the use of ferrite particles in which the magnetic saturation occurs at the magnetic flux density of some hundred gausses. When the density of the finely divided particles of the iron nitride is concentrated to a value higher than the previously mentioned 10 to 25 volume percent, the split-type core assembly according to the present invention can be advantageously improved to exhibit a characteristic comparable to that exhibited by the non-split core assembly and can therefore be used at a high magnetic flux density.

In addition, the finely divided ferromagnetic particles 10 may be in the form of finely divided particles of sintered ferrite, or metal-based magnetizeable particles or nitrided iron-based magnetic particles prepared by the use of a gas-phase method, other than those prepared by the use of the coprecipitation method.

In describing any one of the foregoing preferred embodiments of the present invention, reference has been made to the use of the two windings 52. However, in the practice of the present invention, the number of the windings 52 may not be always limited to two such as shown, but may be a single winding. Also, although reference has been made to the choke, the concept of the present invention can be equally applied to a transformer.

Figure 7A:
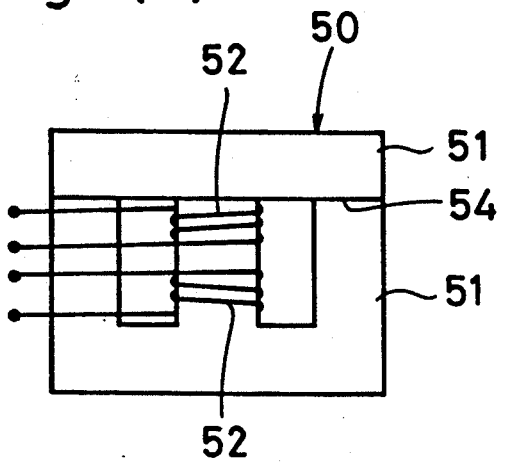
FIGS. 7(A) to 7(C) illustrates various core assemblies to which the concept of the present invention can be applied, respectively.
Figure 7B:
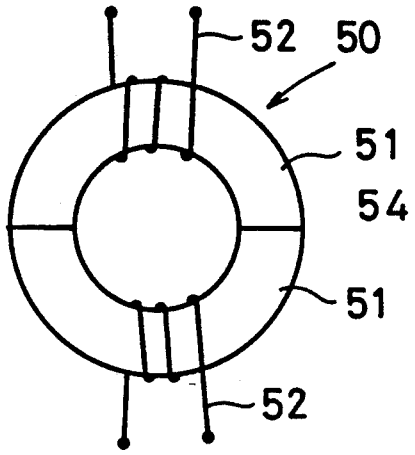
Figure 7C:
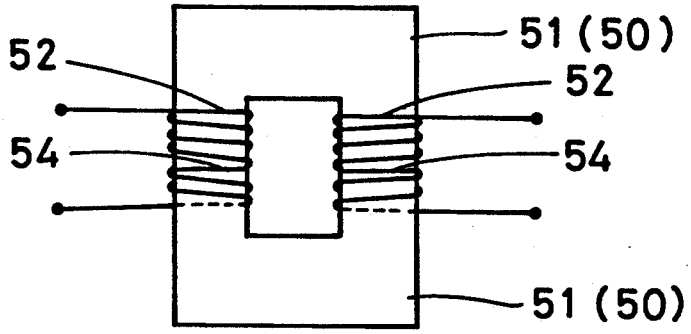

Moreover, the shape of each of the split core segments 51 may not be always limited to the E-shaped configuration such as shown and described. For example, the present invention is equally applicable to the assembly comprising a generally E-shaped core segment and a generally bar-shaped core segment such as shown in FIG. 7(A), the assembly comprising a pair of semicircular core segments such as shown in FIG. 7(B), and the assembly comprising a pair of generally U-shaped core segments such as shown in FIG. 7(C).

Figure 8:
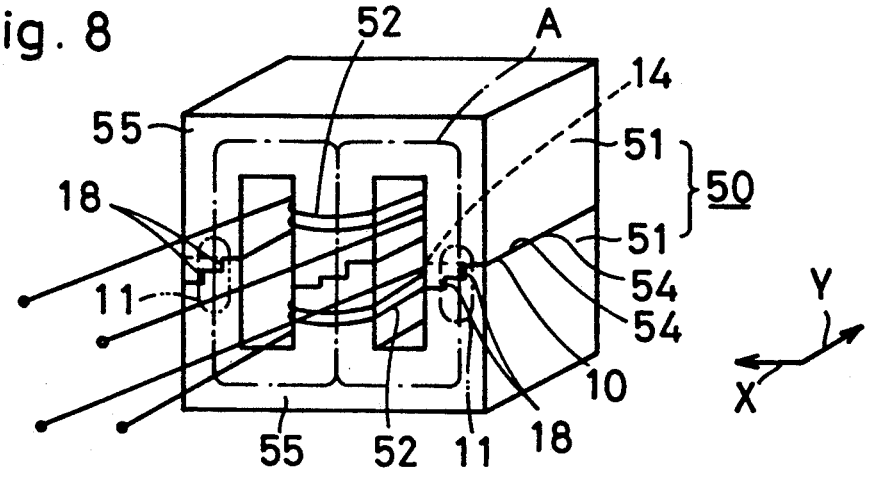
FIG. 8 is a schematic perspective view of the choke according to a fourth preferred embodiment of the present invention.

A fourth preferred embodiment of the present invention is shown in FIG. 8. Referring now to FIG. 8, each of the arms of one core segment 51 has a free end face 54 stepped to provide progressively stepped parallel face areas 18 which lie generally parallel to the magnetic circuit A which would be created in the split-type core assembly 50 when the latter is operated. Correspondingly, each of the arms of the other core segment 51 has a free end face 54 stepped to provide progressively stepped parallel face areas 18 complemental to those in the arms of such one core segment 51. Both of the split core segments 51 are of identical shape thereby improving productivity. Since in the fourth preferred embodiment of the present invention each free end face 54 of the arms of each of the split core segments 51 is not flat and is not therefore ground, it has a surface roughness varying from 20 to 100 μm.

As is the case with any one of the first to third preferred embodiments of the present invention, the finely divided ferromagnetic particles 10 of an average particle size required to form the magnetic fluid medium are interposed between the arms of the respective split core segments 51.

In the structure shown in FIG. 8, since each free end face 54 is progressively stepped as hereinbefore described, the area of surface contact between the split core segments 51 is increased as compared with the assembly wherein each end face of each arm in each of the split core segments lies in a single plane shown by the phantom line 14 perpendicular to the magnetic circuit A such as in any one of the first to third preferred embodiment of the present invention. Although each free end face 54 has a coarse surface due to the progressively stepped feature, the finely divided ferromagnetic particles 10 contained in the magnetic fluid medium 12 can fill up the corresponding gap G between the associated arms of the respective core segments 51 in a manner similar to that shown in and described with reference to FIG. 2. Accordingly, the magnetic permeability at each gap G can be considerably increased. In other words, the magnetic resistance across each gap G between the associated end faces 54 in the respective core segments 51 can be considerably reduced.

A laboratory test has shown that, when the magnetic fluid medium 12 containing the finely divided particles 10 of iron nitride was used, the magnetic permeability of the split-type core assembly as a whole according to the fourth preferred embodiment of the present invention could be improved to 99% of that exhibited by the non-split core assembly having a specific magnetic permeability of about 10,000. Thus, since the magnetic permeability can be advantageously improved, the choke performance of the split-type core assembly 50 according to the present invention can also be improved.

Figure 9A:
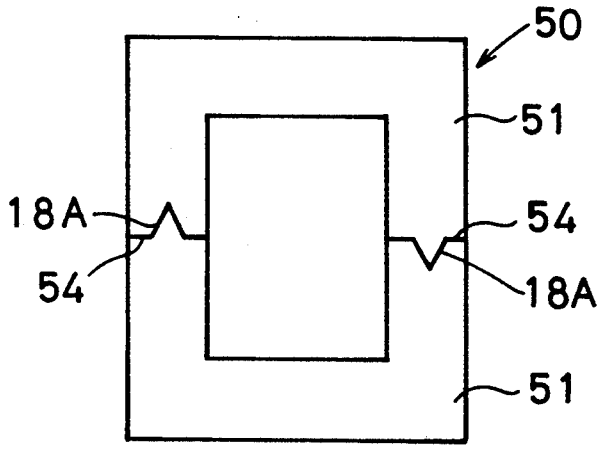
FIG. 9(A) and 9(B) are schematic elevational views of the choke shown in FIG. 8, showing modified forms of the joint between the split core segments, respectively.
Figure 9B:
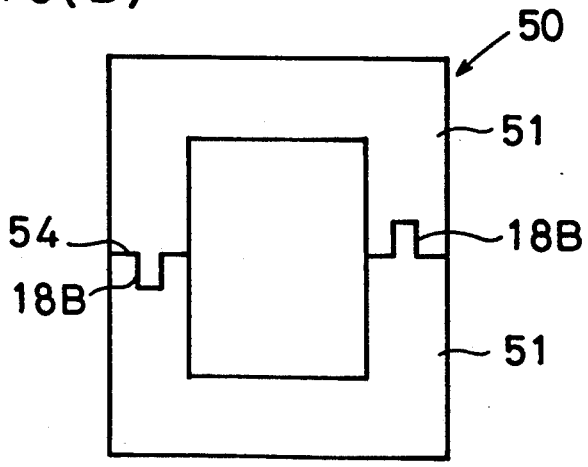

Instead of the employment of the progressively stepped features in each of the arms of the respective split core segments 51, the arms in one core segment 51 may have respective projections while the arms in the other core segment 51 have respective recesses complemental in shape to the associated projections. For example, in the modification shown in FIG. 9(A), a combination of projections 18A each being of a shape similar to the inverted shape of a figure "V" with generally V-shaped recesses is employed. In the different modification shown in FIG. 9(B), a combination of projections 18B each being of a shape having a pair of generally right-angled corners at a free end thereof with generally right-angled recesses is employed. In either case, all that is necessary is to increase the area of surface contact between the split core segments 51 and, as far as each free end face 54 has at least one flat area lying parallel or diagonal to the magnetic circuit A, this requirement is satisfied. Therefore, any suitable shape may be employed for each of the projections and the mating recess. In other words, if each of the arms in each of the split core segments 51 has at least one surface area lying generally parallel or diagonal to the magnetic circuit A, the area of surface contact between the split core segments 51 can be advantageously increased as compared with the case wherein each free end face lies perpendicular to the magnetic circuit A.

A concept of increasing the area of surface contact between the split core segments 51 shown in and described with reference to any one of FIGS. 8 and 9 can be applied to a electromagnetic induction device employing a core assembly having a yoke, that is, a yoke-mounted core assembly.

Figure 10:
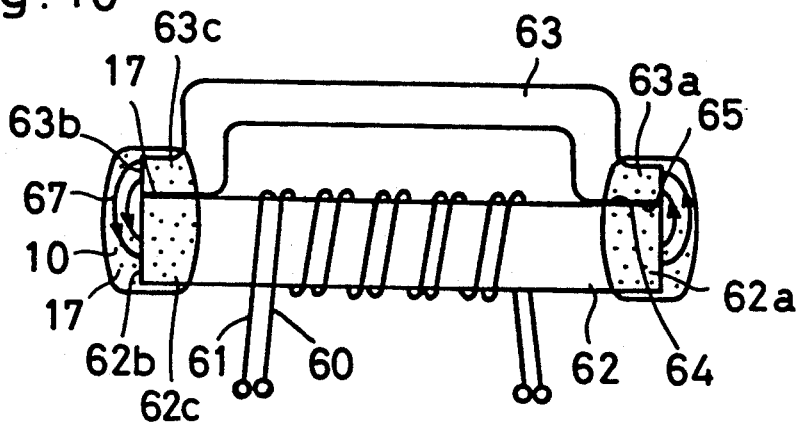
FIG. 10 is a schematic elevational view of a yoke-mounted core assembly according to a fifth preferred embodiment of the present invention.

FIG. 10 illustrates a fifth preferred embodiment of the present invention as applied to the yoke-mounted core assembly. As shown therein, an open-ended core 62 having windings 60 and 61 turned therearound (a type wherein no closed magnetic circuit is formed) has a yoke 63 mounted thereon thereby to form a compact transformer. The core 62 has end portions 62*a* opposite to each other to which associated opposite end portions 63*a* of the yoke 63 is connected in a manner which will now be described. The yoke 63 is mounted on the open-ended core 62 with the end portions 63*a* held parallel to the associated end portions 62*a* of the core 62. The adhesive filler material 17 comprising resin mixed with the finely divided ferromagnetic particles is painted to a contact surface 65 at each end portion 63*a* of the yoke 63 and also to a contact surface 64 at each end portion 62*a* of the core 62 to bond the end portions 63*a* of the yoke 63 and the end portions 62*a* of the core 62 together. Respective end faces 62*b* and 63*b* of the core 62 and the yoke 63 in the vicinity of the joints between the end portions 62*a* of the core and the end portions 63*a* of the yoke 63 are covered by the adhesive filler material 17.

Figure 11:
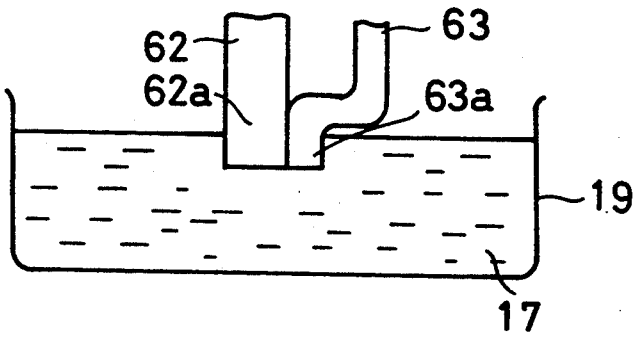
FIG. 11 is a schematic diagram showing how a yoke is connected with a core during the manufacture of the yoke-mounted core assembly of FIG. 10.

In order to make the transformer of the structure shown in FIG. 10, a container or bath 19 containing a quantity of adhesive filler material 17 in a melt form is used as shown in FIG. 11. With the use of the container 19 with the adhesive filler material 17 therein, the end portions 62*a* and 63*a* of the respective core 62 and yoke 63 have to be dipped into the adhesive filler material 17 in the container 19, followed by a heating to dry the adhesive filler material 17 sticking to the end portions 62*a* and 63*a*. By so doing, the adhesive filler material 17 can penetrate deep into each gap, defined between the contact surfaces 64 and 65 at the end portions 62*a* and 63*a*, by the effect of capillarity and, at the same time, bulge outwardly of the respective joint by the effect of a surface tension.

According to the fifth preferred embodiment of the present invention, since the finely divided ferromagnetic particles 10 of an average particle size required to form the magnetic fluid medium fills up each gap between the contact surfaces 64 and 65 at the end portions 62*a* and 63*a* of the core 62 and the yoke 63, the air gap between the contact surfaces 64 and 65 are effectively minimized by the intervention of the finely divided ferromagnetic particles 10. Also, since the finely divided ferromagnetic particles also covers the end faces 62*b* of the core 62 and also the end faces 63*b* of the yoke 63, the lines of magnetic force 67 tending to leak outwardly from the end faces 62*b* and 63*b* pass through the finely divided ferromagnetic particles 10 and, accordingly, effects similar to those afforded by the core assembly having an increased area of contact surface between the split core segments can be appreciated.

Figure 12:
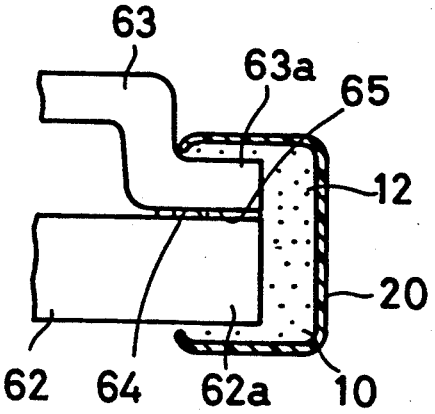
FIG. 12 is a fragmentary sectional view of a portion of the yoke-mounted core assembly according to a sixth preferred embodiment of the present invention.

FIG. 12 illustrates a sixth preferred embodiment of the present invention. In this embodiment, the magnetic fluid medium 12 having no bonding capability is employed and, instead, a clamp cap 20 made of synthetic resin is employed to clamp the mating end portions 62*a* and 63*a* of the core 62 and the yoke 63 while covering a corresponding magnetic fluid medium 12 to avoid any possible flow-out of the finely divided ferromagnetic particles 10.

As hereinbefore described, according to the present invention, the surface indentations and/or cracks appearing in each of the joint faces of the split core segments which are to be brought into contact with each other to complete the split-type core assembly are filled up by the finely divided ferromagnetic particles of an average particle size required to form the magnetic fluid medium. Therefore, the resultant split-type core assembly can exhibit an increased magnetic permeability and, therefore, the electromagnetic induction device utilizing the split-type core assembly can exhibit an improved operating characteristic.

Also, according to the present invention, the joint faces of the split core segments may not be precisely finished smooth and, therefore, there is no substantial possibility that the cost required to manufacture the split-type core assembly embodying the present invention will be unreasonably increased.

Moreover, since the split core segments are mechanically firmly connected together, the split-type core assembly can advantageously withstand the impact which would otherwise result in a displacement of the split core segments relative to each other accompanying a deformation of the gap defined at each joint between the split core segments and resultant reduction in magnetic permeability.

The use of sealing material sealing off the finely divided ferromagnetic particles in the gaps at the respective joints between the split core segments is also effective to avoid any possible reduction in magnetic permeability.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the spirit and scope of the present invention as delivered from the claims annexed hereto, to be construed as included therein.

What is claimed is:

1. An electromagnetic induction device which comprises a split-type core assembly comprising at least one winding formed thereon and first and second core segments, each of said first and second core segments having at least two joint faces spaced apart from each other, said first and second core segments being connected together with said joint faces of one of the first and second core segments held in contact with said joint faces of the other of the first and second core segments, and a finely divided ferromagnetic material interposed between the joint faces of the respective first and second core segments, said ferromagnetic material having an average particle size less than 1 μm interposed to form a magnetic fluid medium.

2. The electromagnetic induction device as claimed in claim 1, further comprising a connecting means for firmly connecting the first and second core segments together.

3. An electromagnetic induction device which comprises a split-type core assembly comprising at least one winding formed thereon and first and second core segments, each of said first and second core segments having at least two joint faces spaced apart from each other, said first and second core segments having at least two joint faces spaced apart from each other, said first and second core segments being connected together with said joint faces of one of the first and second core segments held in contact with said joint faces of the other of the first and second core segments; a magnetic fluid medium including a ferromagnetic material having an average particle size less than 1 μm interposed between the joint faces of the respective first and second core segments; and a sealing means for encompassing an outer perimeter of each of joints defined between the joint faces of the respective first and second core segments.

4. An electromagnetic induction device which comprises a split-type core assembly comprising at least one winding formed thereon and first and second core segments, each of said first and second core segments having at least two joint faces spaced apart from each other, said first and second core segments being connected together with said joint faces of one of the first and second core segments held in contact with said joint faces of the other of the first and second core segments, and hardened deposits of an adhesive filler material interposed between the joint faces of the respective first and second core segments, said adhesive filler material comprising resinous material mixed with finely divided ferromagnetic particles having an average particle size of less than 1 μm to form a magnetic fluid medium.

5. The electromagnetic induction device as claimed in claim 1, wherein each of the joint faces of one of the first and second core segments has at least a surface portion lying generally parallel or diagonal to a magnetic circuit passing across the first and second core segments, and each of the joint faces of the other of the first and second core segments has a surface portion complemental in shape to that in each of the joint faces of such one of the first and second core segments.

6. The electromagnetic induction device as claimed in claim 5, wherein the first and second core segments are of identical shape.

7. An electromagnetic induction device comprising:

an open-ended core having end portions opposite to each other;

at least one winding formed on the open-ended core;

a yoke having end portions opposite to each other, said yoke being mounted on the open-ended core with the opposite end portions of said yoke held parallel to and in abutting relationship with the opposite end portions of the open-ended core: and deposits of finely divided ferromagnetic material an average particle size of less than 1 μm to form a magnetic fluid medium, said deposits being interposed between the opposite end portions of the open-ended core and the opposite end portions of the yoke, each of said deposit of the finely divided ferromagnetic material being formed so as to cover at least end faces of each of the open-ended core and the yoke.

8. The electromagnetic induction device as claimed in claim 7, wherein said finely divided ferromagnetic material is made of iron nitride.

9. An electromagnetic induction device, comprising:

an electromagnetic assembly, including first and second segment means, each having a plurality of end faces, said first and second segment means being connected together at each of the plurality of end faces;

winding means, mounted on said electromagnetic assembly for generating a magnetic field; and finely divided ferromagnetic particles applied between the plurality of end faces of the first and second segment means for electromagnetically bonding the first and second segment means together, said ferromagnetic particles having an average particle size less than 1 μm to form a magnetic fluid medium.

10. The electromagnetic induction device of claim 9, wherein said finely divided ferromagnetic particles are included in resin deposits for structurally bonding the first and second segment means together.

11. The electromagnetic induction device of claim 9, wherein said electromagnetic assembly is a split-type core assembly.

12. The electromagnetic induction device of claim 11, wherein said first and second segment means are of an "E"-shaped configuration.

13. The electromagnetic induction device of claim 9, wherein said finely divided ferromagnetic particles are dispersed in a dispersing agent to form the magnetic fluid medium, and further comprising sealing means applied at the connection of said first and second segment means for preventing evaporation of said dispersing agent.

14. The electromagnetic induction device of claim 10, wherein said resin deposits include additional ferromagnetic particles and a thermosetting resin, which is allowed to harden, thereby structurally bonding said first and second agent means together.

15. The electromagnetic induction device of claim 9, wherein a surface area connecting the plurality of end faces of the first and second segment means is maximized and wherein one surface of the plurality of end faces of the first and second segment is parallel or diagonal to a magnetic current passing through said first and second segment means.

16. The electromagnetic induction device of claim 15, wherein a first one of the plurality of end faces of said first and second segment means has a stepped surface portion and wherein a second one of the plurality of end faces of said first and second segment means is complemental in shape to the first one of the plurality of end faces of said first and second segment means.

17. The electromagnetic induction device of claim 15, wherein a first one of the plurality of end faces of said first and second segment means has a diagonal projection portion, a part of which is diagonal to a magnetic current passing through said first and second segment means and wherein a second one of the plurality of end faces of said first and second segment means are complemental in shape to the first one of the plurality of end faces of said first and second segment means.

18. The electromagnetic induction device of claim 15, wherein said finely divided ferromagnetic particles are iron nitride particles.

19. The electromagnetic induction device of claim 14, wherein said electromagnetic assembly is a yoke-mounted core assembly, said first segment means is an open-ended core, and said second segment means is a yoke.

20. The electromagnetic induction device of claim 9, further comprising:

clamping means for structurally binding the first and second segment means together; and wherein said electromagnetic induction device is a yoke-mounted core assembly, said first segment means is an open-ended core, and said second segment means is a yoke.

21. The electromagnetic induction device of claim 1 wherein said average particle size is within the range of 20 to 300 Å.

22. The electromagnetic induction device of claim 3 wherein said average particle size is within the range of 20 to 300 Å.

23. The electromagnetic induction device of claim 4 wherein said average particle size is within the range of 20 to 300 Å.

24. The electromagnetic induction device of claim 7 wherein said average particle size is within the range of 20 to 300 Å.

25. The electromagnetic induction device of claim 9 wherein said average particle size is within the range of 20 to 300 Å.

* * * * *